United States Patent [19]

Economides

[11] 4,071,082

[45] Jan. 31, 1978

[54] CONVERSION OF A DUAL DUCT, DUAL TEMPERATURE AIR CONDITIONING SYSTEM TO A SINGLE TEMPERATURE SYSTEM

[75] Inventor: Leander Economides, New York, N.Y.

[73] Assignee: Economides & Goldberg, New York, N.Y.

[21] Appl. No.: 632,765

[22] Filed: Nov. 17, 1975

[51] Int. Cl.[2] ..... F28F 27/02; F28F 7/02

[52] U.S. Cl. ..... 165/101; 165/137

[58] Field of Search ..... 165/101, 137, 138, 76

[56] References Cited

U.S. PATENT DOCUMENTS

| | | | |
|---|---|---|---|
| 1,895,876 | 1/1933 | Bennett | 165/101 |
| 2,150,505 | 3/1939 | Hunicke | 165/101 |
| 2,934,324 | 4/1960 | Partington | 165/76 |
| 3,393,729 | 7/1968 | Sauer | 165/137 |
| 3,774,678 | 11/1973 | Glorisi | 165/76 |

*Primary Examiner*—Charles J. Myhre

*Assistant Examiner*—Parshcham S. Lall

*Attorney, Agent, or Firm*—Darby & Darby

[57] ABSTRACT

A method for converting an air conditioning system, for cooling an environment, having respective hot and cold air supply ducts and a dual duct terminal box wherein the hot and cold air is mixed to achieve a desired temperature for delivery to the environment, to a more efficient system by replacing the hot deck of the hot air duct with a cold deck similar to that of the cold air duct and replacing the dual duct box connected to both ducts with one or more types of terminal boxes capable of varying the volume of delivered cooled air to control room temperature. The variable volume terminal boxes may have either limited or unlimited volume variation capability and those with limited variation may be provided with means for heating the residual constant volume furnished at the lower limit of volume variation. The invention also provides for increasing the cooling ability of a system through the use of higher capacity terminal boxes.

9 Claims, 2 Drawing Figures

CONVERSION OF A DUAL DUCT, DUAL TEMPERATURE AIR CONDITIONING SYSTEM TO A SINGLE TEMPERATURE SYSTEM

BACKGROUND OF THE INVENTION

One of the conventional central systems for cooling and/or heating the interiors of large buildings is a dual duct system. In a dual duct system, there are two channels which supply air cooled to a constant temperature and air heated to variable temperatures respectively. One channel contains a cold deck wherein air is cooled to a temperature below room design temperature. The other contains a hot deck wherein air is heated to a temperature at or above room design temperature.

Air from the cold deck and air from the hot deck are separately distributed to mixing boxes through a cold duct and a hot duct respectively.

A mixing box is a device for mixing varying amounts of each of two streams of air at different temperatures to achieve a constant air output at a desired temperature. There are two air valves in the mixing box, one for each of the air streams, both of which are thermostatically controlled by a room or zone thermostat.

In constant volume systems such as these, the flow of total supply air is not varied. To prevent over-cooling when the space served is not subjected to peak cooling loads, as when the outside temperature is below 95° F, building occupancy is reduced below maximum, and/or equipment utilization is below 100%, hot air provided from the heated air duct is mixed with cold air in suitable proportion to maintain a comfortable temperature in the interior of the building. To accomplish this mixing, each area of the space having an environment to be controlled is provided with one or more dual duct (mixing) terminal boxes which receive air from both the cooled and heated air ducts and, under thermostatic control, mix the heated and cooled air to a suitable temperature and expel it into the controlled environment.

The dual duct constant volume system is inherently inefficient in that energy is required to first cool the air for maximum peak conditions and then to heat the cooled air consistent with the immediate load requirements. Such systems, however, are in common use and, until recently, their inefficiency did not result in inordinate expense due to the heretofore relatively low cost of power. However, recent recognition of a growing shortage of energy resources and an attendant sharp rise in the cost of providing power has made the dual duct constant volume system costly to operate for air conditioning.

It is known in the art today to provide only cooling air to building spaces, temperature control being accomplished by varying the volume of the cooled air supplied to the environment to be controlled. Variable volume terminal boxes capable of regulating air volume flow to an environment under thermostatic control responsive to the environmental temperature are known and such systems are now being built in new construction. There are presently in existence, however, numerous plants which employ the older dual duct constant volume system. To replace such systems with a more modern and efficient single duct, single temperature variable volume system requires great expense and inconvenience.

The scrapping of present ductwork and the expense of purchasing new ductwork as well as the labor costs attending both entail additional expense. Furthermore, the limited capacity of a new single ductwork system where the duct size is confined to that of the former ducts places certain constraints on the energy requirements and means for propelling cooled air through the system. What is therefore needed, is an in expensive and facile method for converting older dual duct constant volume systems to function as single duct constant or variable temperature variable volume systems with a minimum of expense while fully utilizing the total volume capacity of the dual duct system.

SUMMARY OF THE INVENTION

The present invention fills the above described need in providing a method for converting dual temperature, dual duct, constant volume systems to function as single duct constant or variable temperature, variable volume systems while significantly increasing system efficiency and lessening air propulsion and cooling power requirements. More specifically, the present invention contemplates the replacement of the hot deck over which air in the heated air duct is passed to raise its temperature with a cold deck similar to the one in the cold air duct over which air is passed to lower its temperature. Thus while two duct channels are still used, both transmit cooled air and, in combination, function in the manner of a single duct system of capacity equal to the combined capacities of the two duct channels.

The dual duct terminal box which mixes the heated and cooled air of the dual duct system under thermostatic control to achieve a final air temperature suitable for maintenance of a desired temperature environment is replaced with one or more terminal boxes connected to either one or both of the ducts. The replacement terminal boxes may be thermostatically controlled to provide an air flow volume to the environment consistent with the environmental cooling requirements. Such variable volume boxes are commercially available. The dual duct terminal box may be converted to variable volume operation by sealing the valves contained therein to regulate hot air flow, e.g., by capping the hot air inlet or outlet. For areas wherein there is a constant cooling load, constant volume terminal boxes may be used with the constant volume preset to provide the necessary air volume flow to cool the room to the desired temperature.

Limited variable volume boxes may be used as terminal units wherein it is desired to vary air flow volume to control temperature but to maintain a minimum ventilation rate and air motion to meet comfort requirements and to comply with municipal codes. Limited variable volume temperature boxes may be connected to the cold air ducts to regulate air flow volume within prescribed limits down to a minimum consistent with the maximum temperature limit of the room. Heating means may also be applied to the limited variable temperature boxes for heating the minimum volume air flow when it is desired to further raise the temperature of the delivered air, as for example when, the cooling load in the room is temporarily reduced or heating is otherwise required.

It is therefore an object of the invention to provide a method for converting a dual temperature, dual duct, constant volume system to function as a single duct constant or variable temperature variable volume system.

Another object of the invention is to accomplish the system conversion with a minimum of component replacements.

Still another object of the invention is to increase the efficiency of a dual duct air conditioning system.

A further object of the invention is to lessen air propulsion requirements in a dual duct air conditioning system.

Still a further object of the invention is to reduce cooling compensation for fan reheat in an air conditioning system.

Other and further objects of the invention will be apparent from the following drawings and description of a preferred embodiment in which like reference numerals are used to indicate like parts in the various views.

DESCRIPTION OF THE PREFERRED EMBODIMENT

Figure 1:
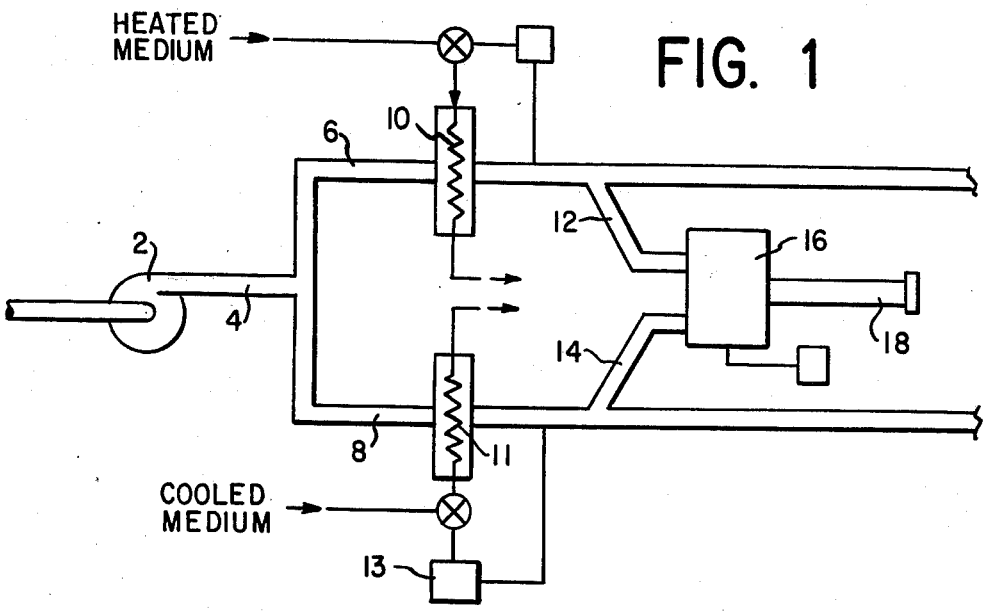
FIG. 1 is a schematic diagram of a dual temperature, dual duct, constant volume air conditioning system.

Referring now to the drawings, specifically FIG. 1, a conventional dual temperature, dual duct constant volume air conditioning system is shown. A supply air fan 2 is disposed in a supply air duct 4. The intake side of the supply air duct receives either fresh outside air or return air from the interior of the air conditioned building or a mixture of both. The return air can be recirculated through a return air duct in which there is disposed a return air fan both of which are not shown.

The side of the supply air duct 4 leading from the outlet of the supply air fan 2 branches into a master hot air duct 6 and a master cold air duct 8. The hot air duct 6 has disposed in it a hot deck 10 which provides a heated surface over which the supply air is passed to raise its temperature to a constant or variable desired level. The hot deck may comprise a coil through which a heated medium is pumped, as for example heated water, under the control of a thermostat 7. The hot deck may also be furnished with an electric heater or a burner fueled by gas or oil, or with a steam heater.

Disposed in the master cold air duct 8 there is a cold deck 11 which provides a chilled surface over which supply air is pumped to lower the temperature of the supply air to a constant or variable desired value. The cold deck may comprise a coil through which a chilled medium is pumped, such as chilled water, under the control of a thermostat 13. Any other refrigerant as for example freon may be used as the chilled medium.

At various locations within the building to be cooled there are distributed dual duct terminal boxes 16. The hot duct of each dual duct box is connected to the master hot duct 6 by hot branch ducts 12. The cold duct of each dual duct box is connected to the master cold duct 8 by cold branch ducts 14. The dual duct boxes are generally provided with mixing valves which are connected to a thermostat 17. The temperature sensing element of the thermostat is generally disposed in the environment which is to have its temperature controlled. Hot air from the master hot duct 6 is mixed with cold air from the master cold duct 8 in each dual duct box 16 so as to expel at its output side, through the outlet duct 18 leading into the environment, air of temperature suitable to bring the environment to a preselected temperature level for which the thermostat is preset.

The maximum volume of cooling air which can be pumped through the system is a function of the horsepower of the fan and the cross-section of the master cold duct 8 among other factors. Characteristically, in dual temperature, dual duct systems, the cross-sectional area of the master hot duct 6 is somewhat less than that of the master cold duct 8. A master hot deck cross-section in a typical system can be expected to be on the order of from 60 to 75% of the cross-sectional area of the master cold duct 8.

By converting the master hot duct 6 to an auxiliary cold duct supplementing the master cold duct 8, the effective cold duct cross-sectional area may be increased thereby lessening fan power requirements to deliver air at a given volume flow rate. Moreover, by eliminating the hot deck 10 and controlling room temperature by varying the volume of cooling air supplied to the controlled environment, as will hereinafter be explained, the energy requirements for heating the cooled air are eliminated.

Thus the invention provides for (1) the conversion of the hot deck 10 of a dual duct system to a cold deck so that the air flowing through both the master ducts 6 and 8 of the system is cold air, (2) elimination of the dual duct terminal boxes 16 used to mix hot and cold air from the respective master dual ducts 6 and 8 in order to control the temperature of the environment served by the terminal boxes, and (3) provision of either one or both of the two master ducts 6 and 8 with conventional terminal devices which either vary the volume of cooling air supplied to the environment under thermostatic control, maintain the volume of cooling air constant and vary its temperature, or vary both the volume and temperature of the air supplied to the environment. The dual duct boxes 16 may also be converted, as previously described, e.g., by sealing off the hot air valve contained therein, to variable volume operation.

Figure 2:
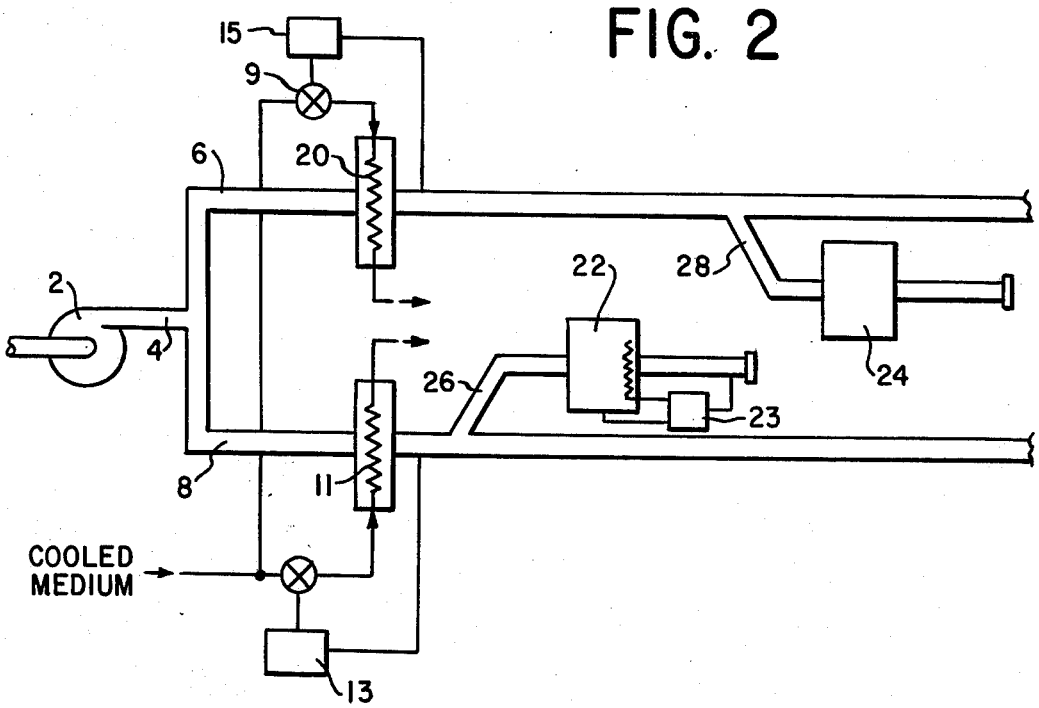
FIG. 2 is a schematic diagram of the dual duct system of FIG. 1 after conversion to a single temperature variable volume system.

The converted system is shown in FIG. 2 of the drawings. The hot deck 10 is replaced with a cold deck 20 similar to the cold deck 11. The heat source used to energize the hot deck coil is disconnected. The new cold deck 20 has a cooling coil through which a cooling medium flows. The cooling coil is connected to appropriate lines from a standard cooling medium source through a thermostatically controlled cooling coil flow regulating valve 9. The same cooling medium source which maintains the temperature of the old cold deck 11 at a desired temperature may be used in conjunction with a new thermostat 15 to cool the new cold deck 20.

The dual duct box 16 is removed and replaced with one or more terminal boxes 22 and 24 as will hereinafter be described. The duct branches 12 and 14 may be used to supply cooled air to the newly added terminal boxes 22 and 24 respectively or one or both of them may be sealed and other branch ducts as for example 26 and 28 may be added extending from the master ducts 6 and 8 as shown in FIG. 2.

As a result of the reduction in duct resistance due to the dual duct cooling air paths 6 and 8, fan speed may be reduced to the point where the converted system total volume air flow equals that of the cooling air flow in master duct 8 alone prior to the conversion. This reduces the fan power requirement and additionally lessens the cooling necessary to compensate for fan reheat, that is, the rise in temperature attributable to the work done on the air by the fan motor.

The new terminal boxes 22 and 24 are selected depending on the type of system to which conversion is desired. The various types of terminal boxes which will hereinafter be described and known to the art and not deemed themselves to be part of the invention. Their inner workings are therefore not shown in the drawings and they are all, instead, schematically represented as elements 22 and 24 of FIG. 2.

Conversion may be made to a single cold temperature constant air flow system by substituting constant volume terminal units as elements 22 and 24 of FIG. 2. This application may be desired in areas where the cooling load does not normally vary. In environments wherein it is desired to reduce the amount of cooling below that furnished by the constant volume terminal unit, a constant volume variable temperature terminal unit may be used. Such units, also commercially available, have a heated surface over which the constant volume cooled air passes as it enters the cooled environment.

Of more universal application is the conversion to variable volume operation with both ducts 6 and 8 delivering cold air in an amount regulated by the terminal unit in response to immediate room temperature. Variable volume terminal boxes are known to the art and are available commercially. In these, generally, either a pneumatic or electric actuator governed by a thermostatic control 23 regulates the air volume flow to the controlled environment in response to the temperature in that environment as sensed by the thermostat temperature sensing element. The higher the desired temperature, the greater is the reduction in cooling air volume flow from the permissible maximum dictated by the capacity of the system. The thermostat element 17 may serve as the thermostat element 23 and may also be used to control the heated surface temperature of a variable temperature terminal box.

Where it is desired that cooling air flow to an environment not fall below a minimum level the terminal units 22 and 24 may comprise limited variable volume terminal units also known to the art and commercially available. In limited variable volume terminal units air volume flow is controlled between a maximum limit as in the case of standard unlimited variable volume units and a fixed minimum limit at or above which it is desired to maintain the air volume flow. Thus, unlike the standard unlimited variable volume unit which permits air flow volume to be reduced to substantially zero, the limited variable volume unit always permits some flow of cooling air to the environment.

Conversion may be made to limited variable volume plus terminal reheat on the unvaried volume. In this case the units 22 and 24 comprise limited variable volume units with heating means for heating the delivered cooled air once the minimum volume flow rate is reached. Depending on the type of heating used, it may be necessary to connect a heating medium system and control for it to the terminal box 22 or 24. The connection of a heat medium system to heat the air delivered through the limited variable volume box is accomplished by procedures known to the art.

In all of the preceding conversions fan speed can be reduced to the point where system air volume flow through the dual ducts 6 and 8 equals system air volume flow through the cold duct 8 alone before the conversion to ensure adequate cooling under conditions of maximum load. Terminal units 22 and 24 as shown in FIG. 2 may comprise any of the previously described terminal units, e.g., constant volume, constant volume-variable temperature, unlimited variable volume, limited variable volume, or limited variable volume with terminal heating on the residual constant volume. Both units may be the same or box 22 may be of one type and box 24 of another. Other terminal units may be added along the system and connected to either or both of master ducts 6 and 8.

It may be desired to convert the original dual duct, dual temperature constant volume system to a system having higher cooling capacity than the original one. This may be accomplished by making the previously described hot deck to cold deck conversion, and depending upon the degree of cooling capacity increase, increasing the capacities of the cooling coils by substituting larger ones. The terminal boxes 22 and 24 should be chosen so that they can handle the increased volume and any of the previously described types of terminal boxes may be used. To achieve the higher cooling capacity the speed of the fan 2 is maintained above the reduced speed required to deliver air through the master ducts 6 and 8 at a volume flow rate equal to that through the master duct 8 before the conversion and may be increased within its rated limit. Should it be desired to increase capacity beyond the limitation of the present fan 2, the fan 2 may be replaced with a larger capacity fan.

Thus, it is seen that by utilizing the hot duct 6 of the old system as a conduit for cold air supplementing the cold duct 8, (1) cooling equal to that of the old system may be accomplished with reduced power expenditure or (2) increased cooling may be provided at a power consumption equal to or less than that in the old system. The savings achieved by such a conversion are shown in the following example in which the subscript 1 is used to denote paramaters applicable to the cooling air flow in the older system of FIG. 1 and the subscript 2 is used to denote parameters applicable to the cooling air flow through the converted system of FIG. 2.

As a result of the conversion, air velocity requirements are reduced for a constant desired amount of cooling.

| | | |
|---|---|---|
| (1) | $V = Q/A$ | $V$ = velocity ft. per min. |
| | or | $Q$ = air flow cubic ft. per min. |
| (2) | $Q = VA$ | $A$ = area in sq. ft. |
| (3) | Let $Q_1 = Q_2$ | $Q_1$ = cfm before conversion |
| | | $Q_2$ = cfm after conversion |
| (4) | then $V_1A_1 = V_2A_2$ | $A_1$ = area of original cold duct |
| | | $A_2$ = combined area of hot and cold duct |
| (5) | and $V_2 = V_1 \frac{A_1}{A_2}$ | $V_1$ = duct velocity in cold duct |
| | | $V_2$ = duct velocity in hot and cold duct |
| (6) | assume $A_2 = 0.6A_1 + A_1 = 1.60A_1$ | |
| (7) | then $V_2 = \frac{1}{1.60} V_1$ | |
| (8) | $V_2 = 0.625V_1$ | |

Thus it is seen that if the cross-sectional area of the old hot duct 6 is 60% that of the cold duct 8, and the previous volume flow rate of delivered cooling air is to be maintained, the required air velocity through the ducts is reduced to 62.5% of the requirement before conversion, i.e., a reduction of 37.5%. If the cross-section of the hot duct 6 were 75% of that of the cold duct 8, the reduction in velocity would be 43%.

The velocity reduction brings about a corresponding decrease in air friction loss through the ducts 6 and 8 and heat exchanger decks which is computed as follows:

(9) $$H_f = F\frac{L}{D}\left(\frac{V}{4005}\right)^2$$

(10) $$\frac{H_f1}{H_f2} = \left(\frac{V_1}{V_2}\right)^2$$

(11) $$H_f2 = \left(\frac{V_2}{V_1}\right)^2 H_f1$$

(12) $$H_f2 = \left(\frac{0.625V_1}{V_1}\right)^2 H_f1$$

(13) $$H_f2 = 0.390\ H_f1$$

$H_f$ = duct air friction loss in. $H_2O$
F = friction factor
L = duct length, ft.
D = duct diameter, ft.
V = mean velocity, fpm
4005 = air velocity equivalent to 1" $H_2O$ Thus it is seen that, where the hot duct 6 cross-sectional area is 60% that of the cold duct 8 cross-sectional area, air friction loss in the decks and dual duct portions of the converted system is 39% of that in the unconverted system, an improvement of 61%.

Since air flow velocity and friction losses are reduced, the brake horsepower needed to drive the fan 2 is also reduced. The brake horsepower reduction is shown below.

(14) $$\frac{BHP_1}{BHP_2}\left(\frac{H_f1}{H_f2}\right)^{\frac{1}{2}}$$

(15) $$BHP_2 = \left(\frac{0.390H_f1}{H_f1}\right)^{\frac{1}{2}} BHP_1$$

(16) $$BHP_2 = 0.1975\ BHP_1$$

$BHP_1$ = air bhp before conversion
$BHP_2$ = air bhp after conversion

Thus an 80% reduction in brake horsepower required to propel the desired amount of cooling air across the decks and through the dual duct portion of the system is achieved.

The reduction in air brake horsepower also results in a reduction in fan shaft brake horsepower that is in the power necessary to drive the fan 2. The fan 2 itself is a heat source which raises the temperature of the air, a phenomenon known as fan reheat. The degree of air temperature increase due to fan reheat is proportional to fan shaft brake horsepower. Any reduction in fan shaft brake horsepower also lessens the air temperature rise attributable to fan reheat. The lessening of the air temperature rise decreases the amount of cooling required to compensate for the air temperature increase attributable to fan reheat.

Continuing with the previous example, the computation of fan reheat and compensatory cooling is shown as follows:

Fan shaft brake horsepower required to drive the fan is proportional to air brake horsepower required to propel the air through the ducts. Thus, shaft brake horsepower after the conversion is equal to 19.75% of shaft brake horsepower before the conversion. Temperature rise due to fan reheat is directly proportional to shaft brake horsepower.

(17) $$dt_1 = \frac{sbhp_1\,(2545)}{1.08Q_1}$$

(18) $$dt_2 = \frac{0.1975sbhp_1\,(2545)}{1.08Q_1}$$

dt = temp. rise F. due to fan reheat
Q = air rate cfm
2545 = btu per sbhp
sbhp = shaft bhp
1.08 = 0.75 lbs of air per cubic ft. times 60 min. per hr. times 0.24 btu per lb. of air per degree F As can be seen from equations (17) and (18) the temperature rise due to fan reheat after conversion is 19.75% of the rise attributable to deck coil and duct friction before conversion. The amount of cooling in tons or BTU's per hour required to compensate for the rise in temperature attributable to fan reheat is proportional to the rise in temperature.

(19) $$T = \frac{1.08Qdt}{12{,}000}$$

t = Ton = 12,000 btu/hr

Thus the required cooling to compensate for fan reheat in the corresponding portion of the converted system is 19.75% of the fan reheat compensation cooling requirement attributable to the decks and dual duct portion of the old system.

It is therefore seen that by converting a dual duct, dual temperature constant volume system to function as a single duct constant or variable temperature variable volume system according to the instant invention, all the benefits of the constant volume system are maintained while (1) energy requirements for propelling cooling air through the system and compensating for fan reheat are substantially reduced and (2) energy requirements for heating air in the hot duct 6 are entirely eliminated. Even where variable volume terminal reheat units are used as terminal boxes 22 and 24, the above benefits are attained to the degree that volume reduction is employed. In addition, the use of the dual ducts to convey cooled air permits the cooling capacity of the system to be increased with minimum alteration of it.

What is claimed is:

1. A method for converting a dual duct, dual temperature constant volume air conditioning system for increased efficiency, said system having first and second parallel ducts, means for propelling air through said ducts, means for heating the air flowing through said first duct, means for cooling the air flowing through said second duct, and terminal air delivery means connected to said first and second ducts for mixing the air in said first and second ducts in suitable proportions to deliver air to an environment which is to be maintained at a preselected temperature comprising:

replacing said means for heating the air in said first duct with means for cooling the air in said first duct, replacing said means for mixing the air in said first and second ducts with terminal means for receiving the air from at least one of said first and second ducts and variably limiting the volume of said air flow to said environment, and adjusting said propelling means to reduce the maximum air flow rate in both ducts.

2. A method according to claim 1 wherein replacement of said mixing means with variable volume terminal means comprises altering said mixing means to operate as variable volume terminal means.

3. A method according to claim 1 wherein said terminal air delivery means for mixing the air in said first and second ducts is responsive to means for sensing the temperature in said environment connected thereto further comprising:

disconnecting said temperature sensing means from said mixing means, and connecting said temperature sensing means to said variable volume terminal receiving means for variably limiting the volume of said air flow in response to the temperature of said environment.

4. A method according to claim 3 wherein said means for cooling the air in said second duct is regulated by first additional temperature responsive means further comprising connecting said means for cooling the air in said first duct to second additional temperature responsive means, said first and second additional temperature responsive means maintaining the cooled air in said first and second ducts at similar temperatures.

5. A method according to claim 3 further comprising the step of connecting to said terminal means, means for heating the air received by said terminal means before discharge into the controlled environment.

6. A method according to claim 5 further comprising the step of connecting said heating means to said temperature sensing means for maintaining said preselected temperature of the environment.

7. A method for converting a dual duct, dual temperature constant volume air conditioning system for increased cooling capacity, said system having a fan with a capacity for propelling air through first and second ducts, means for heating the air in said first duct, means for cooling the air in said second duct, and means for mixing the air in said first duct with the air in said second duct in suitable proportions to deliver to a controlled environment air of suitable temperature, comprising:

replacing said means for heating the air in said first duct with means for cooling the air in said first duct, and replacing said means for mixing the air in said first and second ducts in suitable proportions to achieve a desired temperature with terminal means for receiving the air from at least one of said first and second ducts and delivering the air to the controlled environment.

8. A method according to claim 7 wherein replacement of said mixing means with said terminal means comprises altering said mixing means for single temperature variable volume operation.

9. A method according to claim 7 further comprising replacing said fan with another fan of greater capacity.

* * * * *